US005408707A

United States Patent [19]

Wilson

[11] Patent Number: 5,408,707

[45] Date of Patent: Apr. 25, 1995

[54] PORTABLE SPA APPARATUS

[76] Inventor: Phillip M. Wilson, 2134 Wright Ave., Greensboro, N.C. 27403

[21] Appl. No.: 163,890

[22] Filed: Dec. 8, 1993

[51] Int. Cl.[6] ..... E03C 1/02

[52] U.S. Cl. ..... 4/541.1; 4/506; 4/585; 220/444

[58] Field of Search ..... 4/541.1–541.5, 4/506, 538, 584, 585; 220/4.12, 4.13, 444, 666

[56] References Cited

U.S. PATENT DOCUMENTS

| | | | |
|---|---|---|---|
| 3,537,116 | 3/1970 | Kain | 5/344 |
| 4,546,505 | 10/1985 | Wakenshaw | 4/543 |
| 4,651,791 | 3/1987 | Evenson | 220/666 X |
| 4,843,659 | 7/1989 | Popovich et al. | 4/542 |
| 4,858,254 | 8/1989 | Popovich et al. | 4/542 |
| 4,893,362 | 1/1990 | Murphy | 4/493 |
| 4,932,558 | 6/1990 | Katavolos | 220/666 |
| 4,981,543 | 1/1991 | Popovich et al. | 156/191 |
| 5,025,515 | 6/1991 | Rhines | 4/585 |
| 5,092,951 | 3/1992 | Popovich et al. | 156/184 |
| 5,133,818 | 7/1992 | Popovich et al. | 156/184 |

FOREIGN PATENT DOCUMENTS 1049272 11/1966 United Kingdom .

*Primary Examiner*—Charles E. Phillips
*Attorney, Agent, or Firm*—Rhodes Coats & Bennett

[57] ABSTRACT

A portable spa apparatus comprising a peripheral side wall composite and a floor, which combine to define a tub capable of accommodating at least one occupant and a quantity of liquid. The peripheral side wall composite has an inner liquid-impervious layer; a central layer of flexible, foamed thermoplastic material providing insulating capabilities; and an outer layer of reinforced material. The outer layer has properties that render it capable of withstanding stresses resulting when the spa is partially filled with liquid. Moreover, the peripheral side wall, when constructed, is capable of standing generally upright when the tub is partially filled with liquid. The peripheral side wall and floor are of such construction to be portable and collapsible. Methods for making and using a portable spa apparatus are also disclosed.

32 Claims, 2 Drawing Sheets

FIG. 1
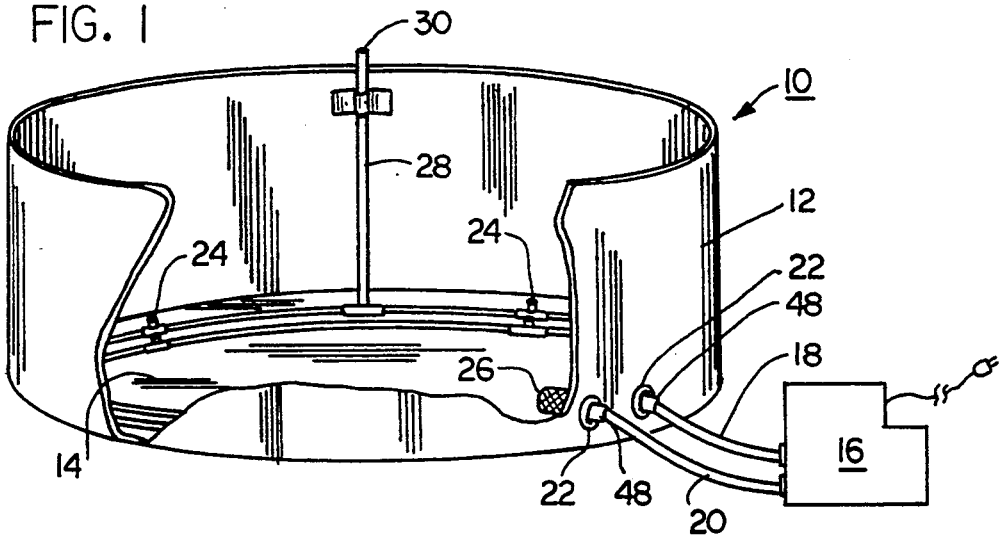
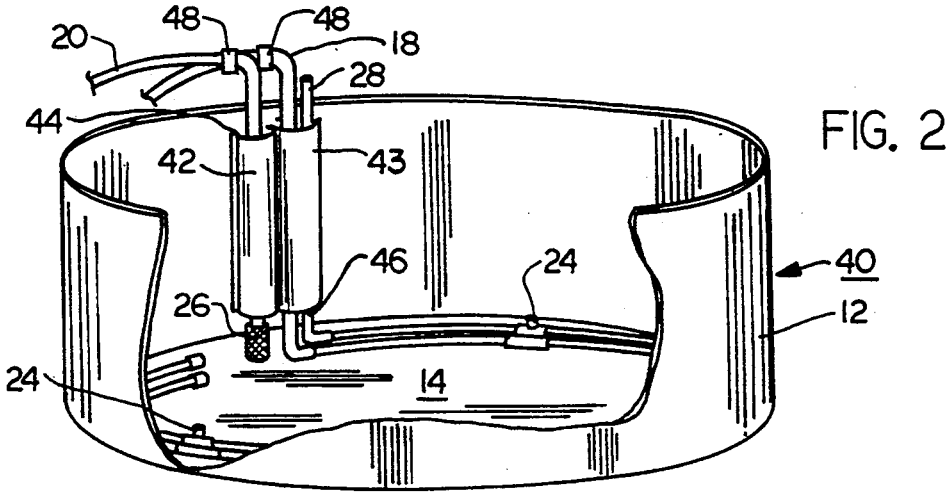
FIG. 2
FIG. 3
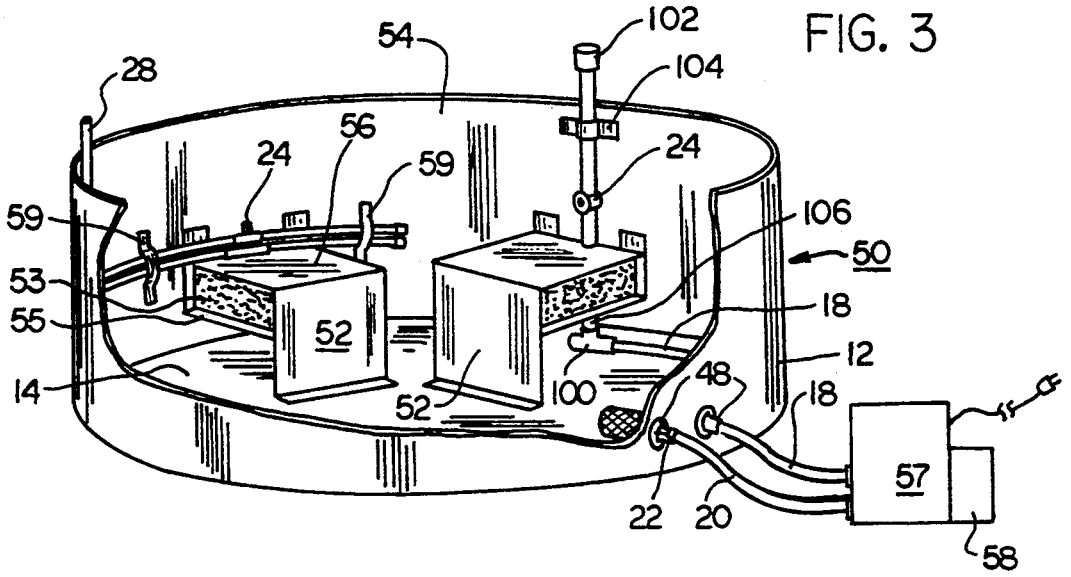

PORTABLE SPA APPARATUS

BACKGROUND OF THE INVENTION

The present invention relates generally to transportable and collapsible spas or "hot tubs," and, more particularly, to a hot tub comprised of mostly flexible elements that can easily be disassembled and transported.

The health and social benefits of spas are well known. Many have experienced the relaxation that results from resting in a comfortably heated body of water and experiencing the muscle stimulation resulting from surrounding liquid and air turbulence. Conventional spas are formed by a rigid structure, such as fiberglass, having openings to fit a plurality of air and liquid jets, and means are provided for circulation and heating of the liquid. However, such spas are designed for permanent installation, are cannot be relocated without great time and expense.

Many locations do not have the space or facilities for a permanent spa installation. Moreover, the cost of a conventional spa preclude many from experiencing their benefits. Those who are renting or leasing properties frequently are prohibited from performing major modifications required for a conventional spa. Convention and meeting organizers also can benefit from a spa that can be easily constructed, operated, disassembled and transported. A portable spa may be of value to rental stores, recreational vehicle users, and others who wish to have the benefits of a spa with easy portability. In addition, there are likely uses in the health care industry, including the provision of temporary sites for underwater birthing.

Several have attempted designs providing some degree of portability. Examples include those set forth in U.S. Pat. Nos. 4,546,505 and 4,893,362. These designs, however, both require many parts, many of which are rigid, which increase costs and diminish the ease with which the spas can be assembled, disassembled and transported. Thus, for all practical purposes, tubs of these designs are "portable" only in the sense that they can be transported as bulky commodities, since they do not have the capability of being collapsed to reduce there volume for transport or storage.

Accordingly, there is a need in the art for a low-cost, easily transportable, easily storable, yet durable hot tub.

SUMMARY OF THE INVENTION

The present invention fulfills this need in the art by providing a truly portable spa apparatus having a peripheral side wall composite and a floor, which combine to define a tub capable of accommodating at least one occupant and a quantity of liquid. The peripheral side wall composite has an inner liquid-impervious layer; a central layer of flexible, foamed thermoplastic material providing insulating capabilities; and an outer layer of reinforced material. The outer layer has properties that render it capable of withstanding stresses resulting when the spa is partially filled with liquid. Moreover, the peripheral side wall, when constructed, is capable of standing generally upright when the tub is partially filled with liquid. Finally, the peripheral side wall and floor are of such construction to be collapsible and portable.

This invention may include a jet assembly that includes a pump and series of hoses. A supply hose is connected to the pump and extends into the tub. At least one supply jet connected thereto allows supply liquid to pass into the tub. A return hose originates from within the tub and extends to the pump to allow liquid within the tub to return to the pump. An air hose with an intake, which is open to the air, extends into the tub. The supply jet is connected to the air hose and to the supply hose and is capable of introducing a turbulent liquid stream and air stream into the tub. Alternatively, two separate supply jets can provide turbulent liquid and air flow, respectively. In a preferred embodiment, the pump is located external to the tub and is capable of passively heating the liquid passing therethrough.

In one embodiment, the peripheral side wall has at least one sleeve, having a bottom open end and a top open end. The sleeve is of sufficient size to allow at least one of the supply hose, return hose or air hose to pass therethrough and to be held in place during operation of the jet assembly.

The tub may include at least one seat having a closed-cell, light-weight, buoyant foam material anchored by suitable material. The seat is sized to accommodate an occupant in a sitting position, and the anchoring material is attached to the peripheral side wall and to the floor. In a preferred embodiment, the seat has a top and the supply jet is positioned on the top of the seat.

Preferably, the central layer of foamed thermoplastic material is a closed-cell foam and of one of the following materials: crosslinked polyethylene, polyurethane, ethylene vinyl acetate, neoprene, styrene butadiene, or ethylene propylene. The outer layer is preferably a vinyl tri-laminate material, which is reinforced with a intermediate polyester scrim layer. The inner liquid-impervious layer is preferably a non-reinforced vinyl material.

In one embodiment of this invention, the peripheral side wall has at least one sealed opening through which the one or both of the supply hose and return hose pass.

The peripheral side wall is preferably about 28 to 30 inches in height. Further, the peripheral side wall, when constructed, is just about capable of standing generally upright when the tub is empty, although it is preferably flexible enough that slight forces can cause it to collapse. When the tub contains water, however, the side wall does stand up, due to the outward force on the wall imparted by the water pressure. The peripheral side wall can be generally cylindrical in shape, but other shapes can be used if desired.

Preferably, the inner layer and outer layer envelop the central layer and are heat sealed together along seams along a top portion of the side wall. In one embodiment, a plurality of decorative wooden slats surrounds the circumference of the tub. The decorative wooden slats can be secured to an additional layer of fabric wrapped around the peripheral side wall.

The floor of the portable spa can have an inner, liquid-impervious layer; a central layer of foamed thermoplastic material; and an outer layer of reinforced liquid-impervious material. Sealing can be obtained where the inner layer of the peripheral side wall has a bottom edge, which is joined to the edge of the inner layer of the floor. Further, the outer layer of the peripheral side wall has a bottom edge, which is joined to the edge of the outer layer of the floor.

More preferably, however, the floor is made up of a single liquid-impervious layer and, perhaps, a tough layer such as a geotextile fabric to provide puncture resistance. The geotextile layer may be separate, in the form of a ground cloth laid on the surface on which the tub is to be located.

Alternatively, the inner layer of the peripheral side wall and the inner layer of the floor can be one continuous material. Similarly, the outer layer of the peripheral side wall and the outer layer of the floor can be one continuous material, just as the central layer of the peripheral side wall and the central layer of the floor can be one continuous material.

In another embodiment, the floor may have an inner, liquid-impervious layer and an outer layer of reinforced material. In this construction, the inner layer of the peripheral side wall has a bottom edge, which is joined to the edge of the inner layer of the floor. The outer layer of the peripheral side wall has a bottom edge, which is joined to the edge of the outer layer of the floor. Again, the inner layer of the peripheral side wall and the inner layer of the floor could be one continuous material; and the outer layer of the peripheral side wall and the outer layer of the floor could be one continuous material.

This invention also provides a method of making a portable spa apparatus including providing a first layer of a flexible, liquid-impervious, non-reinforced material having a top edge, bottom edge and two ends, a second layer of a flexible, foamed, thermoplastic material having a top edge, bottom edge and two ends, and a third layer of a flexible, reinforced material having a top edge, bottom edge and two ends, Then, a peripheral side wall composite is formed by sandwiching the second layer between the first and third layers. The two ends of the third layer are then sealed together, and the two ends of the first layer are sealed together, to form an enclosure. Next, the top edge of the third layer is sealed to the top edge of the first layer and a floor of a flexible, liquid-impervious, non-reinforced material is sealed to the bottom edge of the first layer.

This method may also include the additional steps of locating a pump located external to the tub and connecting a supply hose from the pump to at least one supply jet in the tub, thereby allowing the supply liquid to pass into the tub. The method may also include extending a return hose from within the tub to the pump to allow liquid within the tub to return to the pump; extending an air hose from outside the tub and exposed to the ambient to the supply jet within the tub.

Use of the portable spa is simple. It is done by unfolding a portable spa apparatus made of a flexible, closed-cell foam material, having a liquid-impervious inner layer and sized to fit therein at least one occupant; adding a quantity of liquid to the spa; attaching a recirculating pumping system; operating the recirculating pumping system for a time period to supply agitated liquid and air into the liquid contained within the spa; draining the liquid from the spa; disconnecting the recirculating pumping system; and refolding the portable spa apparatus. If desired, the recirculating pump may be connected with a drain, such as through a garden hose, to permit the pump to be used to drain the liquid from the spa.

The method of using a portable spa may include heating the liquid supplied to the tub.

BRIEF DESCRIPTION OF THE DRAWINGS

The invention will be better understood after a reading of the Description of the Preferred Embodiments and a review of the drawings in which:

FIG. 1 is a perspective view of a portable hot tub according to an embodiment of this invention.

FIG. 2 is a perspective view of a portable hot tub according to an alternative embodiment of this invention.

FIG. 3 is a perspective view of a portable hot tub according to yet another embodiment of this invention.

DESCRIPTION OF THE PREFERRED EMBODIMENTS

Figure 4:
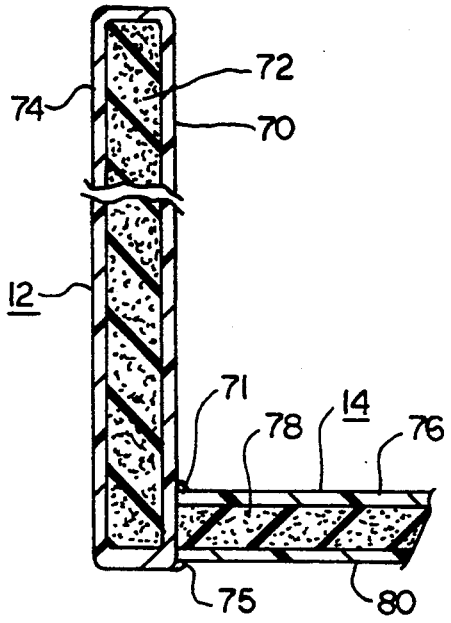
FIG. 4 is a sectional view of an embodiment of the peripheral side wall of this invention.

The drawings are for the purpose of describing the preferred embodiments of the invention and are not intended to limit the present invention.

FIG. 1 illustrates a portable spa apparatus 10 according to an embodiment of this invention. A peripheral side wall composite 12 and a floor 14 combine to define a tub capable of accommodating at least one occupant and a quantity of liquid. The peripheral side wall, when constructed, is capable of standing generally upright when the tub is partially filled with a liquid. When formed, the peripheral side wall and the floor are collapsible and portable, without disassembly.

The apparatus of FIG. 1 also shows a pump 16, which in practice typically will be an electrically powered, recirculating pump. Recirculation pumps, as discussed herein, are well known in the art and are available from several sources. As an optional feature to this invention, the pump can be selected to be of a known design that passively heats the water passing therethrough. Heated water adds greatly to the enjoyment of use of the tub. Also, it is desirable to add a supplemental heater, such as an in-line resistance heater, because by virtue of the portability of the tub, users will often want to heat freshly-filled tubs quickly.

A supply hose 18 and a return hose 20 are connected to the pump. The supply hose provides liquid or water to the tub. In the embodiment shown in FIG. 1, both the supply hose 18 and return hose 20 pass through the peripheral side wall 12 of the tub through two sealed openings 22. It has been found that when the sidewall of the tub is made out of the preferred material described herein, a good connection for hose fittings in openings 22 can be made with a sealant product called Final Vinyl. The supply hose 18, once inside the tub, extends circumferentially around a portion of the tub floor, and is connected to at least one supply jet 24 allowing supply liquid or water to pass therethrough into the tub. The hoses and supply jets are of conventional construction and are easily available to those skilled in the art. The hoses have minimum requirements; they must be capable of withstanding the internal pressure caused by the circulating liquid and, preferably, be flexible and have a plurality of conventional detachably secured fittings to facilitate pump and hose disassembly when the spa is to be transported or stored. Two or more such fittings can be located at the openings 22. Multiple supply and return lines may be provided, if desired.

The return hose 20 is coupled, directly or indirectly, to a liquid suction strainer 26. A liquid suction strainer 26 is located inside the tub and serves to draw the liquid or water inside the tub, back through the return hose 20, to the recirculating pump 16. In a preferred embodiment, the liquid suction strainer 26 has the capability of screening or straining a portion of the contaminants and foreign material from the liquid, prior to returning the liquid to the recirculating pump 16. Liquid suction strainers of the type described herein are well known in the art and are available from several commercial sources. One such source is HydroAir Industries, Inc., whose address is 1317 West Grove Avenue, Orange, CA 92665. Also, if desired, a filter can be included in the liquid supply and/or return hose in conventional fashion.

The pump is preferably provided with a fitting (not shown) to permit attachment of a garden hose, so that the pump may be used to pump the water out of the tub and discharged to a drain (including to a yard) through the garden hose when it is time to empty the tub.

An air hose 28 is also illustrated in FIG. 1. The air hose has an intake 30 that is open to air, and extends within the tub to a supply manifold leading to jets 24. The supply jets 24 are capable of introducing a turbulent liquid and air stream into the tub during operation. Typical jets include a venturi so that the pumped water entrains available air to make the turbulent jet. Alternatively, a separate air jet (not shown) can provide only air to the liquid inside the tube while the supply jet 24 supplies the liquid. As an optional feature, the air hose can be comprised of flexible tubing and a plurality of detachably secured fittings to render the jet assembly easy to disassemble when collapsing the spa for storage or transport. In either instance, the jets can also be capable of adjustment in velocity of the liquid passing therethrough and/or in direction.

FIG. 2 illustrates a portable hot tub 40 according to an alternative embodiment of this invention. A distinction of this embodiment involves the placement on the peripheral side wall of sleeves 42,43 of flexible material, each of which has a bottom open end 46 and a top open end 44. The sleeve is of sufficient size to allow at least one of the supply hose, the return hose or the air hose, to pass therethrough. In FIG. 2, all three of the hoses pass through two separate sleeves 42. Preferably, the sleeve is secured to the interior of the peripheral side wall, in any desired fashion.

Also in FIG. 2, return hose 20 terminates at the liquid suction strainer 26. Detachable secured fittings 48 also are shown at the upper portion of the supply hose 18 and the return hose 20. These fittings 48 allow for the disassembly of the jet assembly, making all of the spa's components easily transportable. The peripheral side wall 12, the floor 14 and a plurality of supply jets 24, are also depicted in FIG. 2.

FIG. 3 depicts yet another embodiment of this invention. A portable spa apparatus 50 is shown, including at least one seat 52. The seat 52 is secured to an interior surface 54 of the peripheral side wall 12. The seat 52 is made of a sheet of material, such as the same material used in the inner face of the side wall. The seat could be of any suitable flexible material including woven, nonwoven, knitted, or netted fabrics. The seat 52 includes a pocket 55 which receives a cushion 53 of a closed-cell, light-weight, buoyant foam material sized to provide buoyancy for at least one occupant in a sitting position. The seat 52 is secured to both the interior surface 54 of the peripheral side wall 12 and to the floor 14 and thus anchors the cushion to stay submerged when the tub is filled, although the submerged cushion still provides support for the user sitting on the seat by virtue of its buoyancy. When it is time to collapse the tub, the cushion 53 may be pulled from the pocket, so that the tub folds up compactly.

Also shown in FIG. 3 is an embodiment for the seat on the left in which a supply jet 24 can rest upon the back of the upper portion 56 of the seat 52. This allows an occupant sitting upon the seat 52 to receive the pleasurable sensation of the turbulent liquid and air stream flowing from the supply jet 24 on the occupant's back. If this embodiment is used, the side wall preferably is provided with straps such as hook-and-loop affixed straps 59.

A preferred embodiment for aiming a jet at a seated user's back is shown on the right in FIG. 3. In this embodiment, the water supply hose 18 passes along the floor to a T-fitting 100 located under the seat 52 and up a branch line 106 to jet 24. Jet 24 is also connected to air intake 102 to permit air to be mixed with water in the jet 24 as described above. Here, the intake is held in place with a strap 104.

While the embodiment of this invention which includes a seat 52 can be used with any other feature of this invention, the seat 52 is shown in FIG. 3 with the supply hose 18 and return hose 20 passing into the tub through openings 22 and fittings 48 in the peripheral side wall 12. (This pass-through arrangement is similar to that shown above in FIG. 1.)

FIG. 3 also depicts an air hose 28 and a pump 57. Pump 57, while similar to the pump 16 shown in FIG. 1, is different in that pump 57 was not selected so as to passively heat the water passing therethrough. The passive heating feature is not as necessary in the embodiment shown in FIG. 3, since a separate heater 58 is included. A heater 58 is provided in series with the supply hose 18, to provide heated liquid or water for the enjoyment of the occupants of the tub. Other sources of heat can be used.

The peripheral side wall shown in each of FIGS. 1, 2 and 3, is preferably between approximately 28 to 30 inches in height. In addition, the peripheral side wall, when constructed, preferably is generally cylindrical in shape. The foam layer is generally thin- on the order of $\frac{3}{4}$ inch thick, which assures the flexibility needed to collapse and fold the tub. At a thickness on that order and with the curvature of the tub sidewall having a radius of about two to four feet, for example, the sidewall is generally capable of standing generally upright when the tub is empty, but is subject to being tipped or collapsed with the application of minimal force. However, when water or other liquid is added, the liquid exerts an outward force is resisted by the reinforced layer, and held upright in part by the stiffness of the foam and in part by its buoyancy in the water, providing stability to the tub so that the sidewall is not easily collapsed or knocked over.

FIG. 4 illustrates a sectional view of an embodiment of a peripheral side wall 12 and a floor 14. The side wall is comprised of an inner layer 70, a central layer 72, and an outer layer 74. The inner layer 70 is liquid-impervious and preferably is formed of non-reinforced 30 mil thick vinyl material.

The central layer 72 is comprised of a flexible, foamed thermoplastic material that provides insulating capabilities to the tub. Preferably, the central layer is a flexible closed-cell foam and of one of the following materials: crosslinked polyethylene, polyurethane, ethylene vinyl acetate, neoprene, styrene butadiene, or ethylene propylene.

The outer layer 74 is a reinforced material having properties that render it capable of withstanding stresses resulting when the spa is partially filled with liquid. Preferably, the outer layer is comprised of a tri-laminate material having two vinyl layers and an intermediate polyester scrim layer. One source for the tri-laminate material is John Boyle & Company, Inc., Salisbury Road, Statesville, N.C. 28677. Any suitable fabric having the strength characteristics needed to withstand the water pressure in the tub with minimal elongation could be used.

As also shown in FIG. 4, the inner layer 70 and outer layer 74 of the side wall envelop the central layer, and can be heat sealed together to form a seam. The seam in FIG. 4 is formed just below the top edge of the side wall, with the outer layer laying over the top edge of the wall.

In the embodiment of FIG. 4, floor 14 is comprised of an inner liquid-impervious layer 76, a central layer 78 of foamed thermoplastic material, and an outer layer of reinforced liquid-impervious material 80. The construction and composition of each layer of the floor in this embodiment is identical to the construction and composition of the equivalent inner layer 70, central layer 72 and outer layer 74, respectively, of the side wall. To form the tub, the bottom edge of the inner layer 70 of the peripheral side wall is joined at area 71 to the edge of the inner layer of the floor. Similarly, a bottom edge of the outer layer 74 of the peripheral side wall is joined at area 75 to the edge of the outer layer 80 of the floor.

Figure 5:
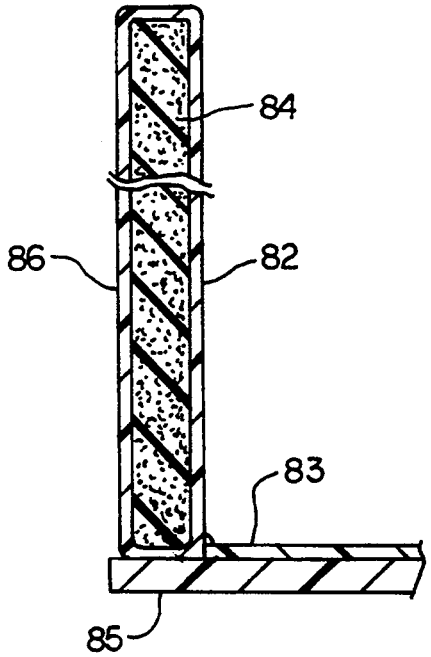
FIG. 5 is a sectional view of another embodiment of the peripheral side wall of this invention.

An alternative, and presently preferred, wall and floor construction is shown in FIG. 5. In this embodiment, the inner layer 82, the central layer 84 and the outer layer 86 are assembled as described above. However, the floor 83 is a single ply of the liquid impervious material. A separate layer of a tough, puncture resistant material 85 is used as a protective ground cover under the tub. The material 85 may be what is conventionally known as a geotextile, and is preferably a woven polypropylene. Polypropylene is difficult to bond with other plastics, so it is generally provided as a separate item, however, any suitable way to affix it to the tub could be used. For example, the polypropylene layer could be interleaved between the inner liquid impervious layer and an outer layer.

Note that while this invention refers to a liquid used in the tub, the preferred liquid is water. Other liquids, however, could also be used.

As a further accessory, a plurality of decorative, vertical wooden slats (not shown) can surround the outer circumference of the tub. This can be accomplished by affixing the slats to a fabric or other flexible substrate by staples, adhesive or the like. The thusbedecked fabric can be wrapped around the tub and affixed to itself with any suitable means, such as hook-and-loop fasteners.

The portable spa apparatus can be made by providing a first layer of a liquid-impervious non-reinforced vinyl material having a top edge, bottom edge and two ends; a second layer of a foamed thermoplastic material having a top edge, bottom edge and two ends; and a third layer of a liquid-impervious reinforced vinyl material having a top edge, bottom edge and two ends, The peripheral side wall composite is formed by sandwiching the second layer between the first and third layer and sealing the two ends of the third layer together, and the two ends of the first layer together, to form an enclosure. Next, the top edge of the third layer is laid over the top edge of the second layer and the top edges are sealed together.

Next, the floor layer or layers are attached along seals described above. As assembled, the tub becomes a transportable, saleable item.

Preferably, the tub is accompanied by the pump and other fluid handling components. These are assembled to the tub by a user and removed for storage or relocation. That is, the pump is located external to the tub, the pump preferably being capable of passively heating the liquid passing therethrough. The hose is connected to the pump and extended into the tub and has at least one supply jet allowing the supply liquid to pass therethrough into the tub. The return hose is positioned to originate within the tub and extend to the pump to allow liquid within the tub to return to the pump. The air hose is positioned so that one end originates outside the tub and is exposed to the ambient and extends to the supply jets within the tub.

Use of the portable spa is simple. It is done by unfolding a portable spa apparatus made of a flexible, closed-cell foam material having a liquid-impervious inner layer and sized to fit therein at least one occupant. A recirculating pumping system including a means for supplying agitated liquid and air into the liquid contained within the spa is attached to the spa. Liquid is added, and the recirculating pumping system is operated for a time period during which the benefits of the spa are experienced by the occupants. When it is desired to store or relocate the spa, the liquid is drained. This may be done by affixing a drain such as a garden hose to the pump and pumping the liquid out of the tub. Then, the recirculating pumping system may be disconnected, and the portable spa apparatus may be collapsed by folding or rolling or a combination thereof.

Figure 6:
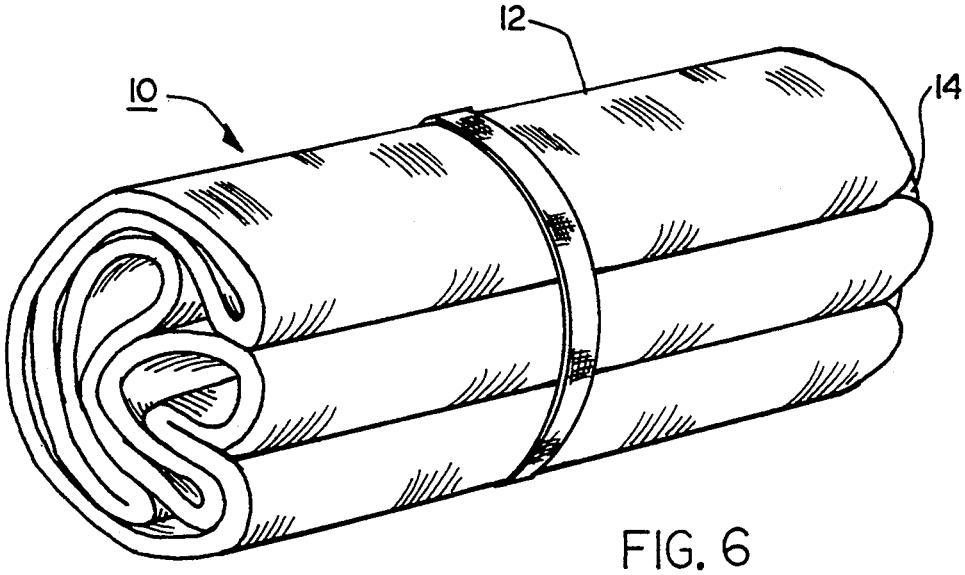
FIG. 6 is a perspective view of an embodiment of the invention in collapsed form, ready for storage or transport.

Because the components are so flexible, the tub can be collapsed to a small volume, making it convenient to store or transport. The tub may be collapsed, for example by urging the sidewall into a flat shape, with the floor tucked up between the two plies resulting. The flat shape may be folded or rolled or a combination thereof to result in the shape shown in FIG. 6.

The above description of the preferred embodiments thus detail many ways in which the present invention can provide its intended purposes. While several preferred embodiments are described in detail hereinabove, it is apparent that various changes might be made without departing from the scope of the invention, which is set forth in the accompanying claims.

I claim:

1. A portable spa apparatus comprising:

(a) a peripheral side wall composite;

(b) a floor, which combines with the side wall to define a tub capable of accommodating at least one occupant and a quantity of liquid;

(c) the peripheral side wall composite having a flexible, inner liquid-impervious layer; a central layer of flexible, foamed thermoplastic material; and an outer layer of reinforced material having properties that render it capable of withstanding stresses resulting when the spa is partially filled with liquid;

(d) the peripheral side wall, when constructed, is capable of standing generally upright when the tub is partially filled with liquid; and (e) the peripheral side wall and floor being of such construction to be collapsible and therefore portable and storable.

2. The portable spa apparatus according to claim 1, wherein the apparatus further comprises a jet assembly having:

(a) a pump;

(b) a supply hose connected to the pump and extending into the tub, and having at least one supply jet allowing supply liquid to pass therethrough into the tub;

(c) a return hose originating from within the tub and terminating at the pump to allow liquid within the tub to return to the pump; and (d) an air hose with an intake opening to air and extending into the tub;

(e) the supply jet connecting to the air hose and to the supply hose and capable of introducing a turbulent liquid and air stream into the tub.

3. The portable spa apparatus according to claim 2, wherein the pump is located external to the tub.

4. The portable spa apparatus according to claim 2, wherein the pump is capable of passively heating the liquid passing therethrough.

5. The portable spa apparatus according to claim 2, wherein the jet assembly further comprises a heater that heats the liquid provided to the tub.

6. The portable spa apparatus according to claim 2, wherein the jet assembly further comprises a liquid suction strainer that serves to screen or strain a portion of the contaminants and foreign material from the liquid prior to the liquid returning to the pump.

7. The portable spa apparatus according to claim 2, wherein the supply hose and return hose are comprised of flexible tubing and have a plurality of detachably secured fittings to render the jet assembly easy to disassemble when transporting the spa.

8. The portable spa apparatus according to claim 2, wherein the air hose is comprised of flexible tubing and has a plurality of detachably secured fittings to render the jet assembly easy to disassemble when transporting the spa.

9. The portable spa apparatus according to claim 2, wherein:

(a) the peripheral side wall further has at least one sleeve, which has a bottom open end and a top open end;

(b) the sleeve being of sufficient size to allow at least one of the supply hose, return hose or air hose to pass therethrough and to be held in place during operation of the jet assembly.

10. The portable spa apparatus according to claim 9, wherein the peripheral side wall has an interior surface and at least one sleeve is secured to the interior surface of the peripheral side wall.

11. The portable spa apparatus according to claim 1, which further comprises at least one seat comprising a closed-cell, light-weight, buoyant foam material and an anchor for the foam material to the peripheral sidewall and to the floor; the closed-cell foam material being secured by the anchor and sized to provide buoyancy for at least one occupant in a sitting position.

12. The portable spa apparatus according to claim 11 wherein the seat has a top and the supply jet is positioned on the top of the seat.

13. The portable spa apparatus according to claim 11, wherein the anchoring portion of the seat is formed of the same liquid impervious material as the inner layer of the sidewall.

14. The portable spa apparatus according to claim 11, further comprising a jet assembly having:

(a) a pump;

(b) a supply hose connected to the pump and extending into the tub, and having at least one supply jet located adjacent the sidewall and above the seat and allowing supply liquid to pass therethrough into the tub;

(c) a return hose originating from within the tub and terminating at the pump to allow liquid within the tub to return to the pump; and (d) an air hose with an intake opening to air and extending into the tub;

(e) the supply jet connecting to the air hose and to the supply hose and capable of introducing a turbulent liquid and air stream into the tub.

15. The portable spa apparatus according to claim 1, wherein the outer layer is comprised of a vinyl tri-laminate material.

16. The portable spa apparatus according to claim 1, wherein the inner liquid-impervious layer is comprised of a non-reinforced vinyl material.

17. The portable spa apparatus according to claim 1, wherein the outer layer of reinforced materials is comprised of a tri-laminate material having two vinyl layers and an intermediate polyester scrim layer.

18. The portable spa apparatus according to claim 1 wherein the peripheral side walls are between 28 and 30 inches in height.

19. The portable spa of claim 1, wherein the peripheral side wall, when constructed, is capable of standing generally upright when the tub is empty, but subject to non-destructively collapsing if forced.

20. The portable spa of claim 1, wherein the peripheral side wall is generally cylindrical in shape when partially filled with liquid.

21. The portable spa apparatus according to claim 1, wherein the inner layer and outer layer envelop the central layer and are heat sealed together in the upper portion of the side wall.

22. The portable spa apparatus according to claim 1, further comprising a plurality of decorative wooden slats surrounding the circumference of the tub.

23. The portable spa apparatus according to claim 22, where the plurality of decorative wooden slats are secured to a suitable material wrapped around the peripheral side wall.

24. The portable spa apparatus according to claim 1, wherein the floor has an inner, liquid-impervious layer and a tough, puncture-resistant outer layer.

25. The portable spa apparatus according to claim 24, wherein the inner layer of the peripheral side wall has a bottom edge, which is joined to the edge of the inner layer of the floor and the outer layer of the peripheral side wall has a bottom edge which is also joined to the edge of the inner layer of the floor.

26. The portable spa apparatus according to claim 1, wherein the inner layer of the peripheral side wall and the inner layer of the floor are one continuous, seamless material.

27. The portable spa apparatus according to claim 2, wherein the peripheral side wall further has at least one sealed opening through which the one or both of the supply hose and return hose pass.

28. The portable spa apparatus according to claim 1, wherein the central layer of foamed thermoplastic material is a closed-cell foam and of one of the following materials: crosslinked polyethylene, polyurethane, ethylene vinyl acetate, neoprene, styrene butadiene, or ethylene propylene.

29. The portable spa apparatus according to claim 1, wherein the floor has an inner, liquid-impervious layer and an outer layer of reinforced liquid-impervious material.

30. The portable spa apparatus according to claim 29, wherein the inner layer of the peripheral side wall has a bottom edge, which is joined to the edge of the inner layer of the floor; and the outer layer of the peripheral side wall has a bottom edge, which is joined to the edge of the outer layer of the floor.

31. The portable spa apparatus according to claim 29, wherein the inner layer of the peripheral side wall and the inner layer of the floor are one continuous material; and the outer layer of the peripheral side wall and the outer layer of the floor are one continuous material.

32. A portable spa apparatus comprising:

(a) a floor;

(b) a peripheral side wall composite, which combines with the side wall to define a tub capable of accommodating at least one occupant and a quantity of liquid; the peripheral side wall composite having an inner liquid-impervious layer; a central layer of flexible, closed-cell foamed thermoplastic material providing insulating capabilities; and an outer layer of reinforced material having properties that render it capable of withstanding stresses resulting when the spa is partially filled with liquid; the peripheral side wall, when constructed, being capable of standing generally upright when the tub is partially filled with liquid; and the peripheral side wall and floor being of such construction to be portable and collapsible; the outer layer being comprised of a vinyl tri-laminate material having two vinyl layers and an intermediate polyester scrim layer; the inner liquid-impervious layer being comprised of a non-reinforced vinyl material; the peripheral side walls being between 28 and 30 inches in height; the inner layer and outer layer envelop the central layer and are heat sealed together along seams in the top portion of the side wall;

(c) a pump, located external to the tub and which is capable of passively heating the liquid passing therethrough;

(d) a supply hose connected to the pump, extending into the tub, and having at least one supply jet allowing supply liquid to pass therethrough into the tub;

(e) a return hose originating from within the tub and terminating at the pump to allow liquid within the tub to return to the pump;

(f) an air hose with an intake opening to air and extending to a manifold in the tub; the supply jet connecting to the manifold and to the supply hose and capable of introducing a turbulent liquid and air stream into the tub; and (g) the peripheral side wall further having a path of sufficient size to allow at least one of the supply hose, return hose or air hose to pass therethrough and to be held in place during operation of the jet assembly;

(h) at least one seat comprising a closed-cell, lightweight, buoyant foam material and an anchor for the foam material to the peripheral sidewall and to the floor; the closed-cell foam material being secured by the anchor and sized to provide buoyancy for at least one occupant in a sitting position; the anchor being attached to the peripheral side wall and to the floor; wherein the seat further has a top and the supply jet is positioned on the top of the seat.

* * * * *